US009617093B2

(12) United States Patent
Okada

(10) Patent No.: US 9,617,093 B2
(45) Date of Patent: Apr. 11, 2017

(54) PAPER FEEDER, IMAGE READING APPARATUS AND IMAGE FORMING APPARATUS INCLUDING THE SAME

(71) Applicant: Kyocera Document Solutions Inc., Osaka (JP)

(72) Inventor: Seiji Okada, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/011,559

(22) Filed: Jan. 30, 2016

(65) Prior Publication Data

US 2016/0236883 A1 Aug. 18, 2016

(30) Foreign Application Priority Data

Jan. 30, 2015 (JP) ..... 2015-016996

(51) Int. Cl.
*B65H 3/06* (2006.01)
*B65H 3/34* (2006.01)
*B65H 5/06* (2006.01)

(52) U.S. Cl.
CPC ..... *B65H 3/0684* (2013.01); *B65H 3/0669* (2013.01); *B65H 3/34* (2013.01); *B65H 5/068* (2013.01); *B65H 2402/64* (2013.01); *B65H 2403/512* (2013.01); *B65H 2403/942* (2013.01); *B65H 2801/06* (2013.01); *B65H 2801/39* (2013.01)

(58) Field of Classification Search
CPC .. B65H 3/0607; B65H 3/0676; B65H 3/0684; B65H 5/06
USPC ..... 271/10.11, 117, 118
See application file for complete search history.

(56) References Cited

U.S. PATENT DOCUMENTS 8,047,531 B1 * 11/2011 Liao ..... B65H 3/0684 217/110
2002/0033572 A1 * 3/2002 Takisawa ..... B65H 3/0669 271/109
2005/0035534 A1 * 2/2005 Kim ..... B65H 3/0615 271/152
2005/0263955 A1 * 12/2005 Kim ..... B65H 3/0684 271/121

(Continued)

FOREIGN PATENT DOCUMENTS

JP 2001-199584 A 7/2001
JP 2004-307151 A 11/2004
JP 2013-234061 A 11/2013

*Primary Examiner* — David H Bollinger
(74) *Attorney, Agent, or Firm* — James Judge

(57) ABSTRACT

A paper feeder includes a housing, a driving unit, a sheet loading portion, a paper feeding unit, and a lock mechanism. The lock mechanism is located in the housing. The paper feeding unit includes a pickup roller, a second shaft portion, a feed roller, a holder, and a stopper. The stopper is swingably supported in the holder, and is configured to change states between a regulation state and a permission state. The regulation state is a state that regulates entrance of the sheet to be loaded in the sheet loading portion into a side of the feed roller side corresponding to the second position of the holder. The permission state is a state that permits entrance of the sheet into the feed roller side corresponding to the first position of the holder. The lock mechanism locks the holder in the second position at a time of non-paper feeding.

4 Claims, 4 Drawing Sheets

(56) References Cited

U.S. PATENT DOCUMENTS

| | | | | |
|---|---|---|---|---|
| 2007/0158898 | A1* | 7/2007 | Hung | B65H 3/0684 271/109 |
| 2008/0303204 | A1* | 12/2008 | Lee | B65H 3/0684 271/121 |
| 2010/0225977 | A1* | 9/2010 | Osanai | B65H 1/04 358/474 |
| 2012/0193863 | A1* | 8/2012 | Harada | B65H 3/0684 271/110 |
| 2013/0119600 | A1* | 5/2013 | Liao | B65H 3/0684 271/117 |
| 2013/0119601 | A1* | 5/2013 | Wu | B65H 3/0669 271/117 |
| 2013/0147107 | A1* | 6/2013 | Hanamoto | B65H 5/00 271/10.01 |
| 2014/0131937 | A1* | 5/2014 | Tsai | B65H 3/0684 271/10.11 |
| 2015/0217952 | A1* | 8/2015 | Hamada | B65H 3/0684 271/227 |
| 2015/0274453 | A1* | 10/2015 | Juan | B65H 3/0607 271/117 |

* cited by examiner

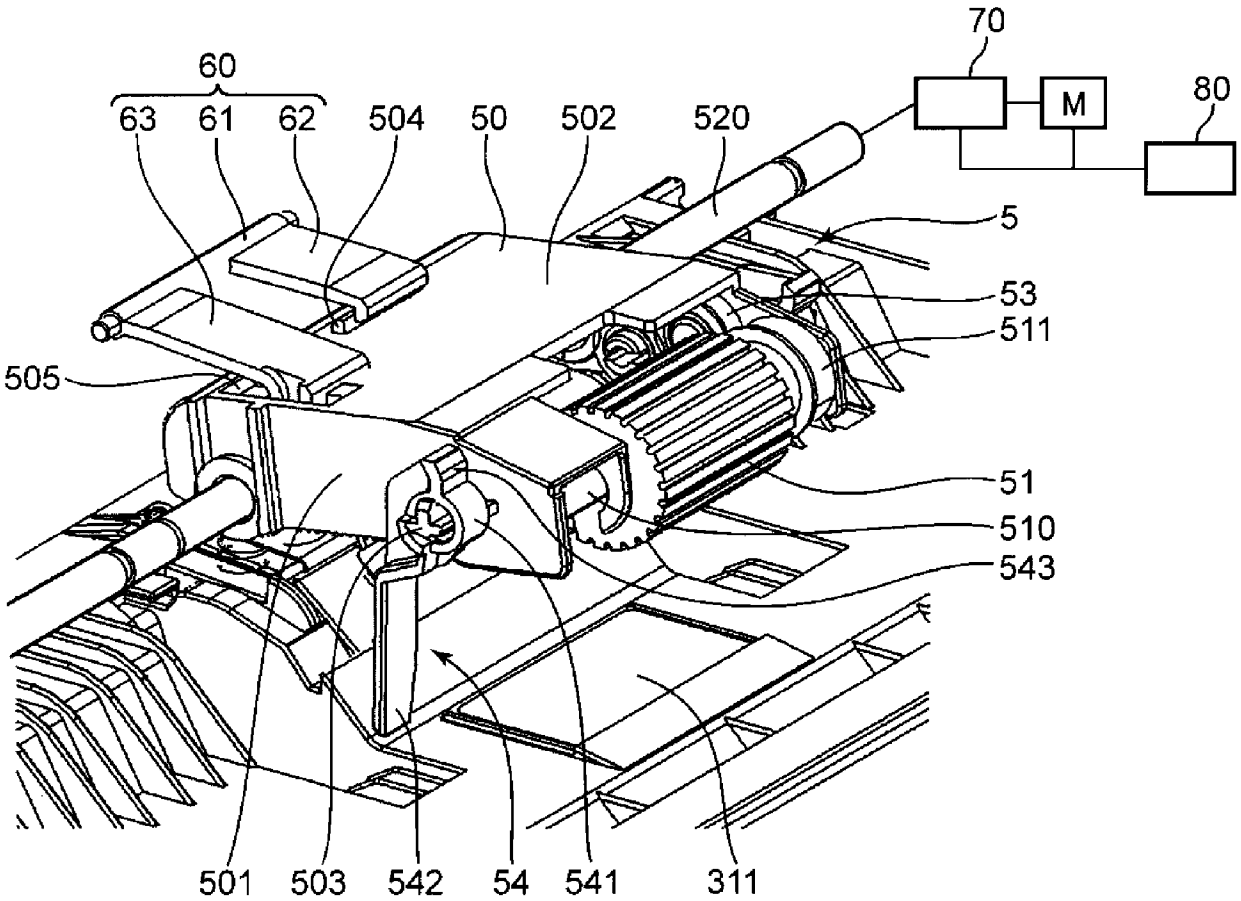
FIG. 2
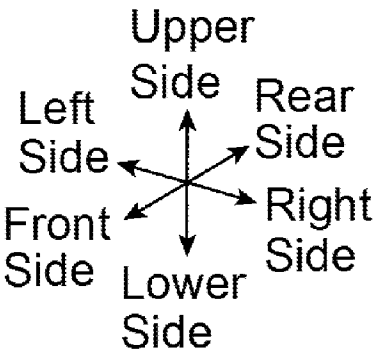

PAPER FEEDER, IMAGE READING APPARATUS AND IMAGE FORMING APPARATUS INCLUDING THE SAME

INCORPORATION BY REFERENCE

This application is based upon, and claims the benefit of priority from, corresponding Japanese Patent Application No. 2015-016996 filed in the Japan Patent Office on Jan. 30, 2015, the entire contents of which are incorporated herein by reference.

BACKGROUND

Unless otherwise indicated herein, the description in this section is not prior art to the claims in this application and is not admitted to be prior art by inclusion in this section.

An automatic document feeding apparatus that is located in an image reading apparatus of an image forming apparatus is known as a paper feeder. In such automatic document feeding apparatus, a paper feeding unit is located facing a plurality of documents (bundle of documents) to be loaded. The paper feeding unit includes a pickup roller and a feed roller. When the pickup roller sends out documents, the feed roller conveys one sheet of documents positioned uppermost of the documents to a downstream side in a sheet conveyance direction.

There is proposed a stopper member that projects into a sheet conveyance path between a pickup roller and a feed roller and prevents documents from entering a periphery of the feed roller at a time of placing documents.

SUMMARY

A paper feeder according to one aspect of the disclosure includes a housing, a driving unit, a sheet loading portion, a paper feeding unit, and a lock mechanism. The sheet loading portion is located in the housing, for loading sheets. The paper feeding unit is supported by the housing and feeding the sheet to be loaded in the sheet loading portion in a predetermined conveyance direction. The lock mechanism is located in the housing. The paper feeding unit includes a pickup roller, a second shaft portion, a feed roller, a holder, and a stopper. The pickup roller includes a first shaft portion. The pickup roller is configured to change positions between a paper feeding position and a non-paper feeding position. The paper feeding position is a position in which the pickup roller is in contact with the sheet to be loaded in the sheet loading portion. The non-paper feeding position is a position in which the pickup roller is separated from the sheet. The pickup roller is rotatably driven around the first shaft portion, and sends out the sheet in the conveyance direction. The second shaft portion is connected to the driving unit and rotatably driven forward and reversely. The feed roller is located in a downstream side in the conveyance direction with respect to the pickup roller, and is rotatably driven forward around the second shaft portion, and conveys the sheet sent out from the pickup roller to the downstream side of the conveyance direction. The holder rotatably supports the pickup roller through the first shaft portion, and is configured to change positions between a first position and a second position. The holder is rotatably driven forward around the second shaft portion changing the position to the first position. The first position causes the pickup roller to be located in the paper feeding position. The holder is rotatably driven reversely around the second shaft portion changing the position to the second position. The second position is a position that causes the pickup roller to be located in the non-paper feeding position. The stopper is swingably supported in the holder, and is configured to change states between a regulation state and a permission state. The regulation state is a state that regulates entrance of the sheet to be loaded in the sheet loading portion into a side of the feed roller side corresponding to the second position of the holder. The permission state is a state that permits entrance of the sheet into the feed roller side corresponding to the first position of the holder. The lock mechanism locks the holder in the second position at a time of non-paper feeding.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 2 obliquely illustrates a periphery of a document feeding unit of a paper feeder according to the one embodiment.

DETAILED DESCRIPTION

Figure 1:
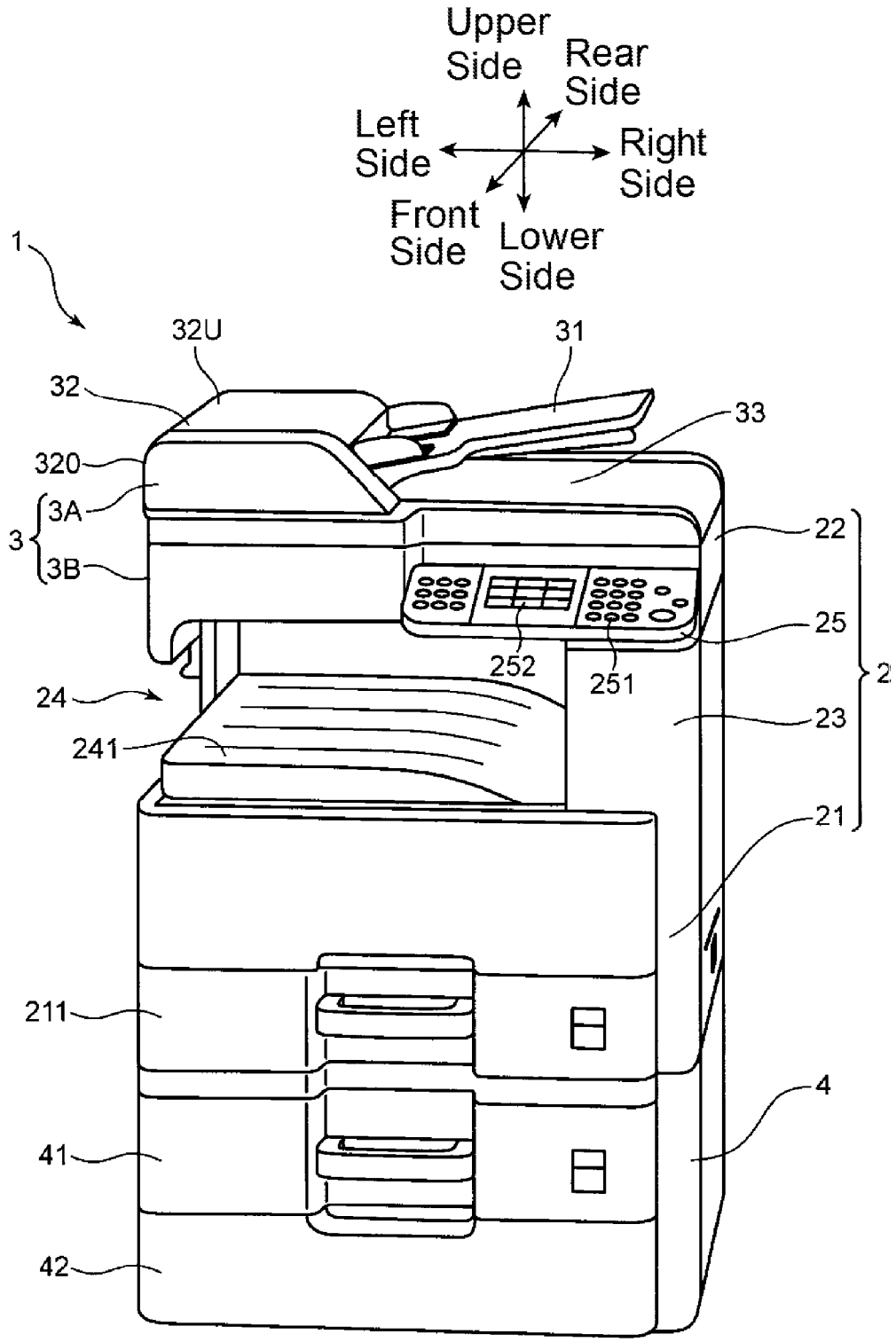
FIG. 1 obliquely illustrates an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be located, substituted, combined, separated, and designed in a wide variety of different configurations, all of which are explicitly contemplated herein.

The following describes embodiments of the disclosure in detail based on the attached drawings. FIG. 1 obliquely illustrates an external appearance of an image forming apparatus 1 according to one embodiment of the disclosure.

The image forming apparatus 1 includes an apparatus main body 2 having an approximately rectangular-shaped chassis structure and an in-barrel space, an automatic document feeding apparatus 3A (paper feeder) located on the top surface of the apparatus main body 2, and an additional paper feeding unit 4 assembled to the lower side of the apparatus main body 2.

The apparatus main body 2 performs an image formation process to a sheet. The apparatus main body 2 includes the following: a lower chassis 21 having an approximately rectangular shape; an upper chassis 22 having an approximately rectangular shape and located over the lower chassis 21; a connection chassis 23 that connects the lower chassis 21 and the upper chassis 22. The lower chassis 21 houses various devices for image formation. Especially, in this embodiment, the lower chassis 21 internally arranges an image forming unit to which a known electrophotography technique is applied. The image forming unit forms images to sheets sent out from a sheet feed cassette 211 or similar cassette. Other image formation techniques such as a known inkjet technique may be applied to the image forming unit. The upper chassis 22 houses an image reading unit 3B (reading unit) to optically read a document image. The automatic document feeding apparatus 3A and the image reading unit 3B constitute an image reading apparatus 3. When a copy function is executed in the image forming apparatus 1, the image forming unit forms images to sheets corresponding to document images read by the image reading unit 3B. An in-barrel space surrounded by the lower chassis 21, the upper chassis 22, and the connection chassis 23 serves as an in-barrel paper discharge unit 24 that can house image-formed sheets. The connection chassis 23, which is located in the right-side surface side of the apparatus main body 2, has a discharge port (not illustrated) for discharging sheets to the in-barrel paper discharge unit 24.

The in-barrel space used as the in-barrel paper discharge unit 24 opens outside in the front surface and the left-side surface of the apparatus main body 2. Users can put their hands in these open areas and take out the image-formed sheets from the in-barrel paper discharge unit 24. A bottom face 241 of the in-barrel space is defined by the top surface of the lower chassis 21, and the sheets discharged from the discharge port are loaded.

An operation panel unit 25 is located projecting from the front surface of the upper chassis 22. The operation panel unit 25 includes operation keys 251 with numeric keypads, a start key, and similar key, a LCD touch panel 252, and similar operation panel. The operation panel unit 25 accepts inputs of various operation instructions from users.

The sheet feed cassette 211, which houses recording sheets to which an image formation process is performed, is mounted to the lower chassis 21. The additional paper feeding unit 4 also includes sheet feed cassettes 41 and 42 that house the recording sheets to which the image formation process is performed. These sheet feed cassettes 211, 41, and 42 are the cassettes located for automatic paper feed, and can house a large amount of recording sheets by size. The sheet feed cassettes 211, 41, and 42 can be pulled out in the front direction from the front surface of the lower chassis 21 or the additional paper feeding unit 4.

The automatic document feeding apparatus 3A is mounted on the top surface of the upper chassis 22 of the apparatus main body 2 and is rotatable in the rear side of the automatic document feeding apparatus 3A. The automatic document feeding apparatus 3A is brought in contact with the top surface of the upper chassis 22. The automatic document feeding apparatus 3A performs automatic paper feed of document sheets to be copied toward a predetermined document reading position in the apparatus main body 2. On the other hand, the automatic document feeding apparatus 3A is opened upward when a user places a document sheet to the predetermined document reading position by hand.

The automatic document feeding apparatus 3A (paper feeder) includes a main body housing 320 (housing), a document feed tray 31 (sheet loading portion), a document conveying unit 32, and a document discharge tray 33. The main body housing 320 is a housing that houses various mechanisms included in the automatic document feeding apparatus 3A.

The document feed tray 31 is a tray located in the main body housing 320, and to which document sheets (sheets), which are fed to the image reading position, are loaded. The document feed tray 31 includes a pair of cursors for adjusting the width of the placed document sheets.

The document conveying unit 32 includes a conveyance path and a conveying mechanism that convey the document sheet on the document feed tray 31 up to the document discharge tray 33 via the image reading position. The document conveying unit 32 is fitted into the main body housing 320 and includes an upper cover unit 32U that forms the top surface portion of the document conveying unit 32. The upper cover unit 32U is located facing to a document feeding unit 5, which will be described later.

The document discharge tray 33 is a tray for discharging the document sheet from which a document image has been optically read. The document discharge tray 33 is located under the document feed tray 31. The top surface of the lower layer portion in the right side of the main body housing 320 is the document discharge tray 33.

Figure 3:
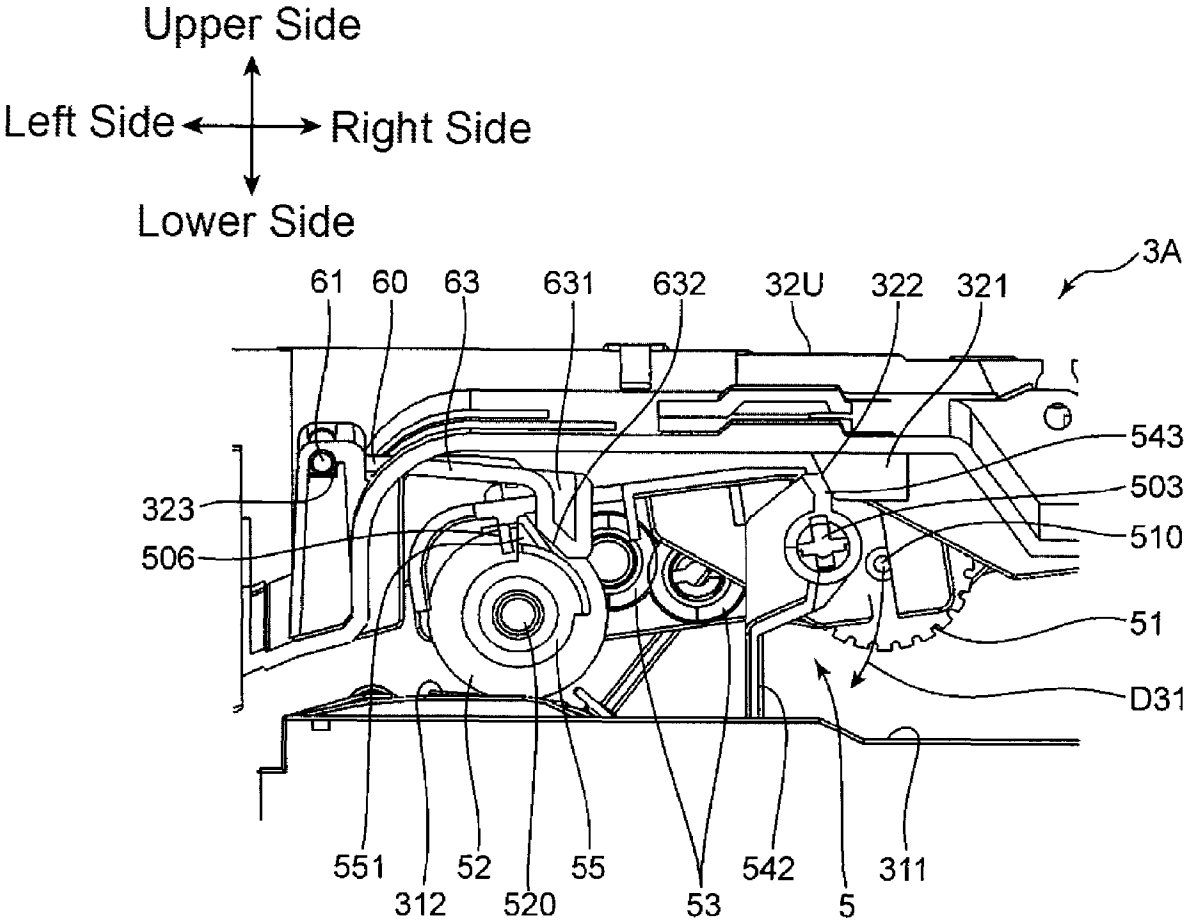
FIG. 3 illustrates a peripheral cross section of the document feeding unit of the paper feeder according to the one embodiment.
Figure 4:
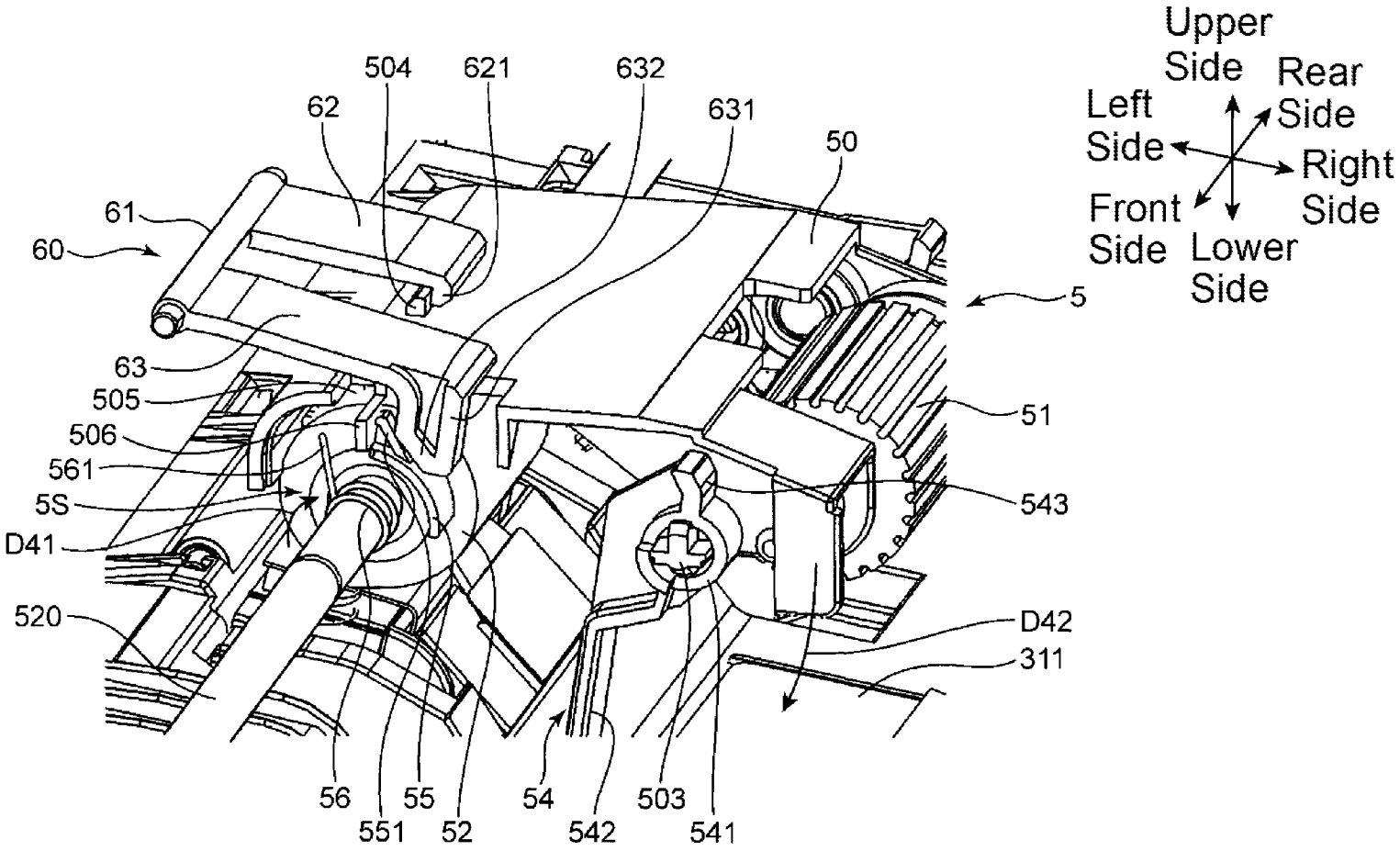
FIG. 4 obliquely illustrates the document feeding unit of the paper feeder according to the one embodiment.

Subsequently, with reference to FIG. 2 to FIG. 4, the following further describes the automatic document feeding apparatus 3A according to the embodiment in detail. FIG. 2 obliquely illustrates a periphery of the document feeding unit 5 of the automatic document feeding apparatus 3A according to the embodiment. FIG. 3 illustrates a peripheral cross section of the document feeding unit 5 of the automatic document feeding apparatus 3A. FIG. 4 obliquely illustrates the document feeding unit 5 of the automatic document feeding apparatus 3A. FIG. 4 illustrates a state where a holder front wall 501 of a holder 50, which will be described later, is cut for describing the inside of the document feeding unit 5. The automatic document feeding apparatus 3A includes the document feeding unit 5 (paper feeding unit), a locking member 60 (lock mechanism), a driving unit M, a clutch 70, and a control unit 80. The document feeding unit 5 is supported by the main body housing 320 and feeds the sheets to be loaded in the document feed tray 31 to a predetermined conveyance direction (in the left direction in FIG. 2). The document feeding unit 5 is located over the downstream side in the conveyance direction of the document feed tray 31. The document feeding unit 5 includes a pickup roller 51, a feed roller 52 (see FIG. 3), the holder 50, idler gears 53, a stopper 54, a cam 55 (cam member: see FIG. 3 and FIG. 4), and a coil spring 56 (torsion spring: see FIG. 4).

The pickup roller 51 sends out the sheets in the document feed tray 31 to the conveyance direction. The pickup roller 51 includes a pickup roller shaft 510 (first shaft portion) and a pickup roller gear 511. The pickup roller shaft 510 is a shaft portion provided projecting from a pair of side surfaces of the pickup roller 51 and serves as a rotation shaft in rotation of the pickup roller 51. Namely, the pickup roller 51 is rotatably driven around the pickup roller shaft 510. The pickup roller shaft 510 is rotatably and pivotally supported by the holder 50. The pickup roller gear 511 is a gear fixed to the rear end portion of the pickup roller shaft 510. The pickup roller 51 can change positions between a paper feeding position and a non-paper feeding position. The paper feeding position is a position where the pickup roller 51 is brought in contact with the sheets to be loaded in the document feed tray 31, and the non-paper feeding position is a position where the pickup roller 51 is separated over the sheets. Rotational movement of the holder 50 achieves this position change of the pickup roller 51. In FIG. 2 to FIG. 4, every pickup roller 51 is located in the non-paper feeding position.

The document feed tray 31 includes an opposed pad 311 (see FIG. 2). The opposed pad 311 is an elastic member that is located opposing to the pickup roller 51. The opposed pad 311 prevents multi feeding of the sheets when the remaining sheets placed in the document feed tray 31 decreases.

The feed roller 52 (see FIG. 3) is located at intervals in the downstream side of the conveyance direction with respect to the pickup roller 51. The feed roller 52 includes a feed roller shaft 520 (second shaft portion). The feed roller shaft 520 is a shaft portion provided projecting from a pair of side surfaces of the feed roller 52 and serves as a rotation shaft in the rotation of the feed roller 52. The feed roller shaft 520 rotatably and pivotally supports the holder 50. As illustrated in FIG. 2, the feed roller shaft 520 passes through the holder 50 and is located so as to extend in the front-rear direction with respect to the holder 50. Then, both the end portions in the front-rear direction of the feed roller shaft 520 are rotatably supported by the main body housing 320. The feed roller 52 is rotatably driven around the feed roller shaft 520 and further conveys the sheets sent out by the pickup roller 51 to the conveyance direction.

The automatic document feeding apparatus 3A includes a separation pad 312 (see FIG. 3). The separation pad 312 is an elastic member that is located facing to the feed roller 52. The separation pad 312 forms a nip area, through which the sheet passes, with the feed roller 52. The separation pad 312 has a function to separate a plurality of sheets sent to the nip area from the document feed tray 31.

As illustrated in FIG. 2, the holder 50 has a flat and approximately rectangular shape. The holder 50 has an opening in its inferior surface portion. The holder 50 rotatably supports the pickup roller 51. The holder 50 is vertically rotated around the feed roller shaft 520, and thus enables the pickup roller 51 to change positions between a first position, where the pickup roller 51 is located at the paper feeding position, and a second position, where the pickup roller 51 is located at the non-paper feeding position. The holder 50 includes the holder front wall 501 (the sidewall), a holder top panel 502 (a top surface portion), a holder shaft portion 503, an engagement projection 504, a holder opening 505, and a holder contacting portion 506 (a wall portion: see FIG. 3 and FIG. 4).

The holder front wall 501 is the sidewall in the front side of the holder 50. Although not illustrated in FIG. 2, a holder rear wall is located facing to the holder front wall 501 in the rear side of the holder 50. The holder top panel 502 is the top panel of the holder 50. The holder top panel 502 connects the holder front wall 501 and the holder rear wall in the front-rear direction. The holder top panel 502 covers the region over the feed roller 52 (see FIG. 2). The holder shaft portion 503 is a projection provided projecting forward from the right-side portion of the holder front wall 501. The holder shaft portion 503 rotatably and pivotally supports the stopper 54, which will be described later. In the holder rear wall also, a holder shaft portion (not illustrated) is similarly provided projecting rearward. Namely, a pair of holder shaft portions is located in the front-rear direction corresponding to a pair of stoppers 54 as described later.

The engagement projection 504 is a projection piece provided projecting upward from the left-side end portion of the holder top panel 502. The engagement projection 504 is provided extending in the front-rear direction with a predetermined length. The holder opening 505 is an opening formed in the front end and left end portion of the holder top panel 502. A pushed-up piece 63 of the locking member 60, which will be described later, can be inserted into the holder opening 505. The holder contacting portion 506 is a projection piece provided projecting downward from the holder top panel 502. As illustrated in FIG. 4, the holder contacting portion 506 is positioned over the feed roller shaft 520. A spring-distal-end portion 561 of the coil spring 56, which will be described later, can be brought in contact with the holder contacting portion 506.

The idler gears 53 (see FIG. 2 and FIG. 3) are the plurality of gears rotatably supported by the holder 50. The idler gears 53 have a function to transmit the rotation of the feed roller shaft 520 to the pickup roller gear 511. The feed roller 52 and the pickup roller 51 are rotationally driven synchronously by the idler gears 53.

The stopper 54 is swingably supported by the holder front wall 501 of the holder 50. The stopper 54 has a function to regulate a distal-end set position of the document sheets. In the embodiment, the stopper 54 is pivotally supported by the holder 50. For details, the stopper 54 includes a stopper shaft hole 541 (fulcrum portion), a regulating portion 542, and a contacting portion 543. The stopper shaft hole 541 is a cylindrically-shaped member. The stopper shaft hole 541 is inserted into the holder shaft portion 503 of the holder front wall 501 and is rotatably and pivotally supported by the holder shaft portion 503. The regulating portion 542 is provided extending downward from the stopper shaft hole 541 and can regulate the sheets loaded in the document feed tray 31. The contacting portion 543 is provided extending upward from the stopper shaft hole 541.

The stopper 54 can change states between a regulation state and a permission state. That is, in the regulation state, the stopper 54 regulates entrance of the sheets loaded in the document feed tray 31 into the feed roller 52 side, corresponding to the second position of the holder 50. On the other hand, in the permission state, the stopper 54 permits entrance of the sheets into the feed roller 52 side, corresponding to the first position of the holder 50. Although not illustrated in FIG. 2, a similar stopper is located also in the holder rear wall side of the holder 50.

The cam 55 (see FIG. 3 and FIG. 4) is pivotally supported by the feed roller shaft 520 and is a rotatable member. The cam 55 includes a cam pressing portion 551 (a projection). The cam pressing portion 551 has a function to push up the pushed-up piece 63 of the locking member 60, which will be described later, upward.

The coil spring 56 is a spring member located around the feed roller shaft 520. The coil spring 56 is wound multiple times around the feed roller shaft 520. One end (not illustrated) of the coil spring 56 is provided radially projecting from the circumference surface of the feed roller shaft 520 and fixed to the cam 55. The distal end of the one end of the coil spring 56 can be brought in contact with the right side surface of the holder contacting portion 506 of the holder 50, in conjunction with the reverse rotation of the feed roller shaft 520. The spring-distal-end portion 561 of the other end of the coil spring 56 is provided radially projecting from the circumference surface of the feed roller shaft 520, as illustrated in FIG. 4. The spring-distal-end portion 561 can be brought in contact with the left-side surface of the holder contacting portion 506 of the holder 50, in conjunction with the forward rotation of the feed roller shaft 520.

The cam 55 and the coil spring 56 have a function similar to a known torque limiter. That is, when the feed roller shaft 520 is rotationally driven, the cam 55 integrally rotates with the feed roller shaft 520 by a predetermined rotation angle. Then, when a load of a predetermined value or more is applied to the cam 55, the diameter of the coil spring 56 is deformed and expanded, and thus the cam 55 idles with respect to the feed roller shaft 520.

The locking member 60 is supported by the main body housing 320 (housing). The locking member 60 has a function to fix the holder 50 to the second position at a time of non-paper feeding, when the document feeding unit 5 does not perform a paper feeding operation. The locking member 60 includes a locking shaft 61, a locking piece 62, and the pushed-up piece 63. The locking shaft 61 serves as a rotation shaft in the rotational movement of the locking member 60. The locking shaft 61 is rotatably supported by a locking supporting portion 323, which will be described later, located in the main body housing 320. The locking piece 62 is a projection piece provided projecting toward the right side from the rear end portion of the locking shaft 61. The locking piece 62 includes a locking claw 621. The locking claw 621 is formed with the distal end portion of the locking piece 62 bent downward. The locking claw 621 can engage with the engagement projection 504 of the holder 50. The pushed-up piece 63 is a projection piece provided projecting toward the right side from the front end portion of the locking shaft 61. That is, the pushed-up piece 63 is provided at intervals in an axial direction with respect to the locking piece 62, and is provided projecting from the locking shaft 61, approximately in parallel with the locking piece 62. The base end portion (one end portion) of the pushed-up piece 63 is supported by the locking shaft 61, and the distal end portion (the other end portion) of the pushed-up piece 63 can be brought in contact with the cam 55. With reference to FIG. 4, the pushed-up piece 63 is located over the cam 55. The pushed-up piece 63 includes a pushing-up protrusion 631. The pushing-up protrusion 631 is a projection piece provided projecting further downward from the distal end portion of the pushed-up piece 63. The pushing-up protrusion 631 includes a pushed-up surface 632. The pushed-up surface 632 is an inclined surface located in the left side and lower portion of the pushing-up protrusion 631. The pushed-up surface 632 inclines to descend forward along the rotation direction (clockwise in FIG. 3) of the feed roller 52 in conjunction with the paper feeding operation. The cam pressing portion 551 of the cam 55 can be brought in contact with the pushed-up surface 632.

With reference to FIG. 3, the upper cover unit 32U includes a main body regulating portion 321 (contacted portion) and the locking supporting portion 323. The main body regulating portion 321 is a projection provided projecting downward toward the document feeding unit 5 from the inferior surface portion of the upper cover unit 32U. The main body regulating portion 321 includes a regulating surface 322. The regulating surface 322 is a left-side surface of the main body regulating portion 321. The contacting portion 543 of the stopper 54 can be brought in contact with the regulating surface 322. The locking supporting portion 323 is a pivotally supporting portion located inside the upper cover unit 32U. The locking supporting portion 323 is a supporting portion rotatably supporting the locking shaft 61 of the locking member 60. With reference to FIG. 3, the locking supporting portion 323 swingably supports the locking member 60. The pushing-up protrusion 631 does not further rotate downward around the locking shaft 61 with respect to the position illustrated in FIG. 3. In FIG. 3, the base end portion (the proximity of the locking shaft 61) of the pushed-up piece 63 is brought in contact with a regulating surface (not illustrated), which is located in the upper cover unit 32U in the right side with respect to the locking supporting portion 323 and faces upward, by its own weight. Thus, this regulates a further clockwise rotational movement of the locking member 60 from the state in FIG. 3. As described later, this is effective to prevent the following failure: if the cam pressing portion 551 rotates clockwise around the feed roller shaft 520 from the state illustrated in FIG. 3 and the cam pressing portion 551 is located downward with respect to the pushing-up protrusion 631, and then the pushing-up protrusion 631 drops downward with respect to the position illustrated in FIG. 3, the cam pressing portion 551 strongly interferes with the pushing-up protrusion 631 when the cam pressing portion 551 reversely rotates (counterclockwise). On the other hand, the locking member 60 is brought in contact with (rest on) the regulating surface in the periphery of the locking supporting portion 323 by its own weight. Thus, the locking member 60 including the pushed-up piece 63 can rotate counterclockwise around the locking shaft 61 such that the pushed-up piece 63 moves upward from the state illustrated in FIG. 3.

Among the respective members of the document feeding unit 5 and the locking member 60, the cam 55, the pushed-up piece 63, the holder contacting portion 506, and the coil spring 56 constitute an interlocking mechanism 5S (see FIG. 4) according to the embodiment. The interlocking mechanism 5S, by interlocking with the forward rotation of the feed roller 52, releases a lock state of the holder 50 by the locking member 60 and also moves the holder 50 to the first position from the second position. The interlocking mechanism 5S, by interlocking with the reverse rotation of the feed roller 52, causes the lock function of the holder 50 by the locking member 60 to be executed, and also causes the holder 50 to move to the second position from the first position.

The driving unit M is a motor that generates a driving power causing the pickup roller 51 and the feed roller 52 to rotate. In this embodiment, the driving unit M further causes other members (not illustrated) of the automatic document feeding apparatus 3A to be rotatably driven. The driving unit M is connected to the feed roller shaft 520 via the clutch 70. The driving unit M can rotate forward and reversely.

The clutch 70 is located between the driving unit M and the feed roller shaft 520, and switches transmission of the driving power of the driving unit M to the feed roller shaft 520 and release of the transmission. When the driving unit M rotates forward, and the clutch 70 transmits the driving power of the driving unit M to the feed roller shaft 520, the feed roller 52 and the pickup roller 51 rotate. As described above, this transmits the driving power to the pickup roller gear 511 from the feed roller shaft 520 via the idler gears 53. Further, this rotates the holder 50 downward around the feed roller shaft 520, and moves the pickup roller 51 to the paper feeding position. On the other hand, when the driving unit M rotates reversely, and the clutch 70 transmits the driving power of the driving unit M to the feed roller shaft 520, the feed roller 52 and the pickup roller 51 rotate reversely. This rotates the holder 50 upward around the feed roller shaft 520, and moves the pickup roller 51 to the non-paper feeding position. To prevent reverse rotation of the pickup roller 51 and the feed roller 52 when the driving unit M rotates reversely, one-way gear (not illustrated) may be located in the document feeding unit 5.

The control unit 80 causes the driving unit M to rotate forward or reversely and also switches the drive transmission operation of the clutch 70, corresponding to the paper feeding operation of the document feeding unit 5. Arrangement of the clutch 70 enables detachment of the transmission of the driving power to the document feeding unit 5 while transmitting the driving power of the driving unit M to the other members of the automatic document feeding apparatus 3A. This ensures causing the driving unit M to drive a plurality of members that are driven in different timings, and ensures achieving cost reduction of the automatic document feeding apparatus 3A.

As illustrated in FIG. 2 to FIG. 4, when the holder 50 is located in the second position around the feed roller shaft 520, the pickup roller 51 is located in the non-paper feeding position. In this case, even if a user pushes a sheet strongly to the feed roller 52 side, the regulating portion 542 of the stopper 54 regulates the distal end of the sheet. Then, when the distal end of the sheet presses the regulating portion 542, the contacting portion 543 of the stopper 54 is brought in contact with the regulating surface 322 of the upper cover unit 32U, as illustrated in FIG. 3. Thus, this prevents the clockwise rotational movement of the stopper 54 with the holder shaft portion 503 as fulcrum, from the state illustrated in FIG. 3, and maintains the regulation state of the stopper 54. Consequently, this stably maintains the regulating force by the stopper 54 against a sheet.

On the other hand, as described above, the clutch 70 transmits the driving power of the driving unit M to the feed roller shaft 520 in this embodiment. Then, when paper feeding is not performed, and causing the other members of the automatic document feeding apparatus 3A to drive, the control unit 80 controls the clutch 70 to detach the transmission of the driving power to the feed roller shaft 520. In this case, the rotation of the feed roller shaft 520 is not regulated, and thus, the holder 50 easily rotates downward slightly by the own weight of the holder 50 or similar factor. Then, if the contacting portion 543 (see FIG. 3) detaches from the regulating surface 322, the stopper 54 may become rotatable. As just described, if the holder 50 is unstably located in the second position, the regulation state of the stopper 54 is not maintained, and thus the regulating force of the stopper 54 easily becomes insufficient. Strong impact or vibration applied to the upper cover unit 32U may cause such position variation of the holder 50.

In this embodiment, to solve the problem as described above, the locking member 60 locks the holder 50 when the holder 50 is located in the second position. Especially, the locking claw 621 engages with the engagement projection 504 (see FIG. 2), and thus, the holder 50 is stably locked to the second position. This prevents the holder 50 from displacing downward and stably maintains the regulating force by the stopper 54 against the sheet at the time of the non-paper feeding.

With reference to FIG. 3 and FIG. 4, during the paper feeding operation of the automatic document feeding apparatus 3A, the feed roller shaft 520 rotates in an arrow D41 direction in FIG. 4 when the driving power of the driving unit M is transmitted to the feed roller shaft 520 via the clutch 70. In this case, the cam pressing portion 551 of the cam 55 pushes up the pushed-up surface 632 of the pushed-up piece 63 upward, and thus, the locking member 60 rotates upward around the locking shaft 61. This releases the engagement of the locking claw 621 and the engagement projection 504, and thus releases the lock state of the holder 50.

Immediately after the cam pressing portion 551 pushes up the pushed-up surface 632, the spring-distal-end portion 561 of the coil spring 56, which is rotationally driven in the arrow D41 direction in FIG. 4, presses the holder contacting portion 506 of the holder 50. This moves the holder 50 to the first position from the second position (an arrow D31 in FIG. 3 and an arrow D42 in FIG. 4) while rotating the holder 50 around the feed roller shaft 520. In this case, the contacting portion 543 of the stopper 54 is separated downward from the regulating surface 322. Thus, the stopper 54 becomes possible to rotate around the holder shaft portion 503. The stopper 54 is pressed by the sheet sent out by the pickup roller 51, and then, the regulating portion 542 rotates to move to the downstream side in the conveyance direction. In other words, the stopper 54 becomes the permission state, which permits the sheets to enter the feed roller 52 side corresponding to the first position of the holder 50.

When the holder 50 is located in the first position, and the pickup roller 51 is located in the paper feeding position, the rotation of the pickup roller 51 and the feed roller 52 feeds the sheets in the document feed tray 31 toward the image reading position (not illustrated).

When the paper feeding operation of the document feeding unit 5 terminates, the control unit 80 controls the driving unit M to reversely rotate the feed roller shaft 520. This rotates the holder 50 around the feed roller shaft 520 in the direction reverse to the arrow D31 in FIG. 3. In this case, the cam 55 returns to the original rotation position around the feed roller shaft 520 by the elastic force of the coil spring 56. When the holder 50 reaches the second position again, the holder 50 slightly pushes up the locking member 60 that has been brought in contact with the locking supporting portion 323 (see FIG. 3) by its own weight. Then, the engagement projection 504 engages with the locking claw 621 again, and thus, the holder 50 is locked in the second position.

As described above, the automatic document feeding apparatus 3A according to the embodiment, and the image reading apparatus 3 and the image forming apparatus 1 that include the automatic document feeding apparatus 3A stably maintain the regulating force of the stopper 54 at the time of the non-paper feeding. This ensures alignment of the sheets to be loaded in the document feed tray 31 and stable conveyance of the sheets to the image reading position when paper feeding operation is started. Further, this ensures stable image formation to the sheets corresponding to document images read by a reading unit. The disclosure is not limited to these embodiments, and, for example, the following modifications can be employed.

(1) The embodiments described above have been described in the aspect that the locking member 60 rotates around the locking shaft 61 by its own weight; however, the disclosure is not limited to the own weight of the locking member 60. The following aspect may be employed: a coil spring (not illustrated) is located to the locking shaft 61, and this coil spring biases the locking piece 62 and the pushed-up piece 63 downward. In this case, when the holder 50 moves to the second position, the pushed-up piece 63 is pushed up upward by the cam pressing portion 551 against the biasing force of the coil spring.

(2) The embodiments described above have been described using the automatic document feeding apparatus 3A as a paper feeder; however, the disclosure is not limited to this. A paper feeding unit that faces to the inside of the sheet feed cassette 211 and has a structure similar to the automatic document feeding apparatus 3A may be located. In this case, the paper feeding unit feeds the sheets toward an image forming unit.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A paper feeder, comprising:

a housing;

a driving unit;

a sheet loading portion located in the housing, for loading sheets;

a paper feeding unit supported by the housing and feeding the sheet to be loaded in the sheet loading portion in a predetermined conveyance direction;

a lock mechanism located in the housing, and including a locking shaft rotatably and pivotally supported by the housing, and a locking piece provided extending from the locking shaft, the lock mechanism being rotatably driven around the locking shaft; and an interlocking mechanism; wherein the paper feeding unit includes a pickup roller including a first shaft portion, the pickup roller being configured to change positions between a paper feeding position and a non-paper feeding position, the paper feeding position being a position in which the pickup roller is in contact with the sheet to be loaded in the sheet loading portion, the non-paper feeding position being a position in which the pickup roller is separated from the sheet, the pickup roller being rotatably driven around the first shaft portion, and sending out the sheet in the conveyance direction, a second shaft portion connected to the driving unit and rotatably driven forward and reversely, a feed roller that is located in a downstream side in the conveyance direction with respect to the pickup roller, and is rotatably driven forward around the second shaft portion, and conveys the sheet sent out from the pickup roller to the downstream side of the conveyance direction, a holder including a pair of sidewalls that pivotally support the first shaft portion and are pivotally supported by the second shaft portion, a top surface portion that intersects the pair of sidewalls and covers an upper region over the feed roller, and an engagement projection provided projecting upward from the top surface portion, the holder therein rotatably supporting the pickup roller through the first shaft portion, and being configured to change positions between a first position and a second position, the holder rotatably driven forward around the second shaft portion changing the position to the first position, the first position causing the pickup roller to be located in the paper feeding position, the holder rotatably driven reversely around the second shaft portion changing the position to the second position, the second position being a position that causes the pickup roller to be located in the non-paper feeding position, and a stopper that is swingably supported in the holder and configured to change states between a regulation state and a permission state, the regulation state being a state that regulates entrance of the sheet to be loaded in the sheet loading portion into a side of the feed roller side corresponding to the second position of the holder, the permission state being a state that permits entrance of the sheet into the feed roller side corresponding to the first position of the holder;

the holder is locked in the second position by engagement of the locking piece with the engagement projection when the holder moves from the first position to the second position;

the housing includes a contacted portion provided projecting toward the paper feeding unit;

the stopper includes a fulcrum portion rotatably and pivotally supported by one sidewall of the pair of sidewalls of the holder, a regulating portion that is provided extending downward from the fulcrum portion and configured to regulate the sheet, and a contact portion that is provided extending upward from the fulcrum portion, and when the holder is moved to the second position, the contact portion is brought in contact with the contacted portion, so as to regulate rotation of the stopper around the fulcrum portion and put the stopper in the regulation state;

the interlocking mechanism includes a cam member that includes a projection and is rotatable by the second shaft portion, a pushed-up piece that is provided projecting from the locking shaft, at intervals in an axial direction of the locking shaft with respect to the locking piece, and has one end portion supported by the locking shaft and another end portion in contact with the cam member, the pushed-up piece being swingable around the locking shaft, a wall portion provided projecting downward from the top surface portion in the holder, and a coil spring that has one end and another end, the one end being fixed to the cam and configured to contact one sidewall of the wall portion, the other end being configured to contact another sidewall of the wall portion, the other sidewall being a backside of the one sidewall, the coil spring being wound around the second shaft portion a plurality of times, and disposed to be rotatable unitarily with the second shaft portion, the interlocking mechanism interlocking with rotation of the feed roller by the forward rotation of the second shaft portion;

when the second shaft portion is rotatably driven forward, the projection of the cam member pushes the pushed-up piece upward to rotatably drive the lock mechanism around the locking shaft, so as to release engagement of the locking piece and the engagement projection, and release a lock state of the holder by the lock mechanism, and the other end of the coil spring presses the one sidewall of the wall portion, so as to move the holder from the second position to the first position while the holder is rotatably driven around the second shaft portion; and the lock mechanism locks the holder in the second position at a time of non-paper feeding.

2. The paper feeder according to claim 1, further comprising:

a clutch that is located between the driving unit and the second shaft portion, and switches transmission of the driving power to the second shaft portion and release of the transmission.

3. An image reading apparatus, comprising:

the paper feeder according to claim 1 that conveys the sheet as a document; and a reading unit that reads a document image of the sheet.

4. An image forming apparatus, comprising:

the image reading apparatus according to claim 3; and an image forming unit that forms an image onto a sheet, corresponding to the document image read by the reading unit.

* * * * *